US009954336B2

(12) United States Patent
Salois

(10) Patent No.: US 9,954,336 B2
(45) Date of Patent: Apr. 24, 2018

(54) FEEDER DEVICE

(71) Applicant: Tyco Electronics Corporation, Berwyn, PA (US)

(72) Inventor: Thomas W. Salois, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 760 days.

(21) Appl. No.: 14/331,708

(22) Filed: Jul. 15, 2014

(65) Prior Publication Data

US 2016/0020571 A1 Jan. 21, 2016

(51) Int. Cl.

| | |
|---|---|
| ***H01R 43/05*** | (2006.01) |
| ***H01R 43/052*** | (2006.01) |
| ***H01R 43/055*** | (2006.01) |
| ***H01R 43/28*** | (2006.01) |
| *H01R 43/048* | (2006.01) |

(52) U.S. Cl.

CPC ..... *H01R 43/052* (2013.01); *H01R 43/055* (2013.01); *H01R 43/28* (2013.01); *H01R 43/048* (2013.01); *Y10T 29/53213* (2015.01)

(58) Field of Classification Search

CPC .. H01R 43/052; H01R 43/055; H01R 43/048; Y10T 29/53213

See application file for complete search history.

(56) References Cited

U.S. PATENT DOCUMENTS

| | | | | |
|---|---|---|---|---|
| 4,139,937 A * | 2/1979 | L'Homme | ..... | H01R 43/20 29/235 |
| 6,367,148 B1 * | 4/2002 | Caveney | ..... | H01R 43/055 29/33 M |
| 2007/0000124 A1 | 1/2007 | Shandersky et al. | | |

* cited by examiner

*Primary Examiner* — Peter DungBa Vo
*Assistant Examiner* — Jeffrey Carley

(57) ABSTRACT

A feeder device includes a feed finger and a lifting arm. The feed finger is mounted to and movable relative to the frame along a feed stroke in a feed direction and in an opposite return direction. The feed finger is pivotable towards and away from a feed object. The lifting arm is fixedly mounted to the frame. The feed finger moves relative to the lifting arm as the feed finger is moved along the feed stroke. The lifting arm has a deflectable tip engaging the feed finger. The deflectable tip is deflected as the feed finger is moved in the feed direction. The deflectable tip is un-deflected as the feed finger is moved in the return direction. The un-deflected tip engaging the feed finger and pivoting the feed finger away from the feed object as the feed finger is moved along the lifting arm in the return direction.

14 Claims, 6 Drawing Sheets

FEEDER DEVICE

BACKGROUND OF THE INVENTION

The subject matter herein relates generally to feeder devices that eliminate return drag on a fed object.

In typical terminal crimping systems, a terminal and a wire are both fed to a crimping zone of an applicator. The applicator includes crimp tooling that defines the crimping zone. The crimp tooling is configured to mechanically crimp the terminal to the wire to produce an electrical lead. The terminal crimping systems may use a wire feeder device and/or a terminal feeder device to deliver the respective wire and terminals to the crimping zone for each crimping operation. Some wire and terminal feeder devices use a linear indexing feed member that moves linearly in a feed direction and in an opposite return direction. The feed member of such feeder devices is designed with the purpose of selective engagement of the feed object (such as the wire or the terminal). For example, the feed member engages the feed object as the feed member moves in the feed direction to advance the feed object toward the crimping zone, while the feed member disengages the feed object as the feed member moves in the return direction. Thus, although the feed member indexes back and forth between an advanced position and a retracted position, the object that is being fed should only move in one direction, the feed direction.

In some feeder devices, the feed member is forced downwards against the fed object as the feed member moves in the feed direction by a biasing member, such as a torsion spring. The force applied to the feed member by the biasing member must be strong enough to overcome friction forces and tension from the source of the fed object (for example, a bulk wire source). On the return stroke, though, the strong force applied by the biasing member may not allow the feed member to completely disengage from and clear the fed object as the feed member moves in the return direction. The feed member, for example, may scrape the wire that is being fed, and the scraping may be sufficient to damage the wire by removing a protective coating on the wire or even severing at least part of the conductive core of the wire.

Additionally, the feed member may pull back on the fed object which interferes with the position of the fed object in the crimping zone, even causing the object to move backwards at least partially out of the crimping zone. Such interference in the position of the fed object by the movement of the feed member in the return direction may cause the fed object, whether it be the wire or the terminal, to misalign with the other of the wire and the terminal in the crimping zone. Electrical leads have to meet very strict lead specifications and quality standards. A wire that is not properly located in either the side-to-side or front-to-back directions relative to the terminal, and vice-versa, will not meet the lead specifications and are usually discarded. Leads that do not meet the specifications are discarded, which wastes time and materials. Therefore, in some known linear indexing feeder devices, the feed member moving in the return direction damages the fed object and/or interferes with the position of the object in the crimping zone, which degrades the quality of the resulting produced lead.

BRIEF DESCRIPTION OF THE INVENTION

In an embodiment, a feeder device includes a feed finger and a lifting arm. The feed finger is mounted to a frame and movable relative to the frame along a feed stroke that includes movement of the feed finger in a feed direction and in an opposite return direction. The feed finger has a distal edge configured to engage a feed object during at least part of the feed stroke. The feed finger is pivotable towards and away from the feed object. The lifting arm is fixedly mounted to the frame and disposed adjacent to the feed finger. The feed finger moves relative to the lifting arm as the feed finger is moved along the feed stroke. The lifting arm has a deflectable tip engaging the feed finger as the feed finger is moved along the lifting arm. The deflectable tip is deflected as the feed finger is moved in the feed direction. The deflectable tip is un-deflected as the feed finger is moved in the return direction. The un-deflected tip engaging the feed finger and pivoting the feed finger away from the feed object as the feed finger is moved along the lifting arm in the return direction.

In an embodiment, a terminal crimping system includes an applicator and a feeder device. The applicator includes a ram and an anvil. The anvil is located in a crimping zone and configured to receive a terminal thereon. The ram is movable towards and away from the anvil along a crimp stroke. When the ram moves towards the anvil, crimp tooling at an end of the ram is configured to crimp the terminal to a wire that is disposed in the crimping zone. The feeder device is configured to feed the wire to the crimping zone. The feeder device includes a frame and a feed finger mounted to the frame. The feed finger is movable relative to the frame along a feed stroke that includes movement of the feed finger in a feed direction and in an opposite return direction. The frame includes a feed track that receives the wire thereon. The feed finger has a distal edge configured to engage the wire on the feed track during at least part of the feed stroke. The feed finger is pivotable towards and away from the feed track. As the feed finger is moved in the feed direction, the feed finger is pivoted towards the feed track and the distal edge engages the wire and advances the wire towards the crimping zone. As the feed finger is moved in the return direction, the feed finger is pivoted away from the feed track and the distal edge does not engage the wire.

DETAILED DESCRIPTION OF THE INVENTION

Figure 1:
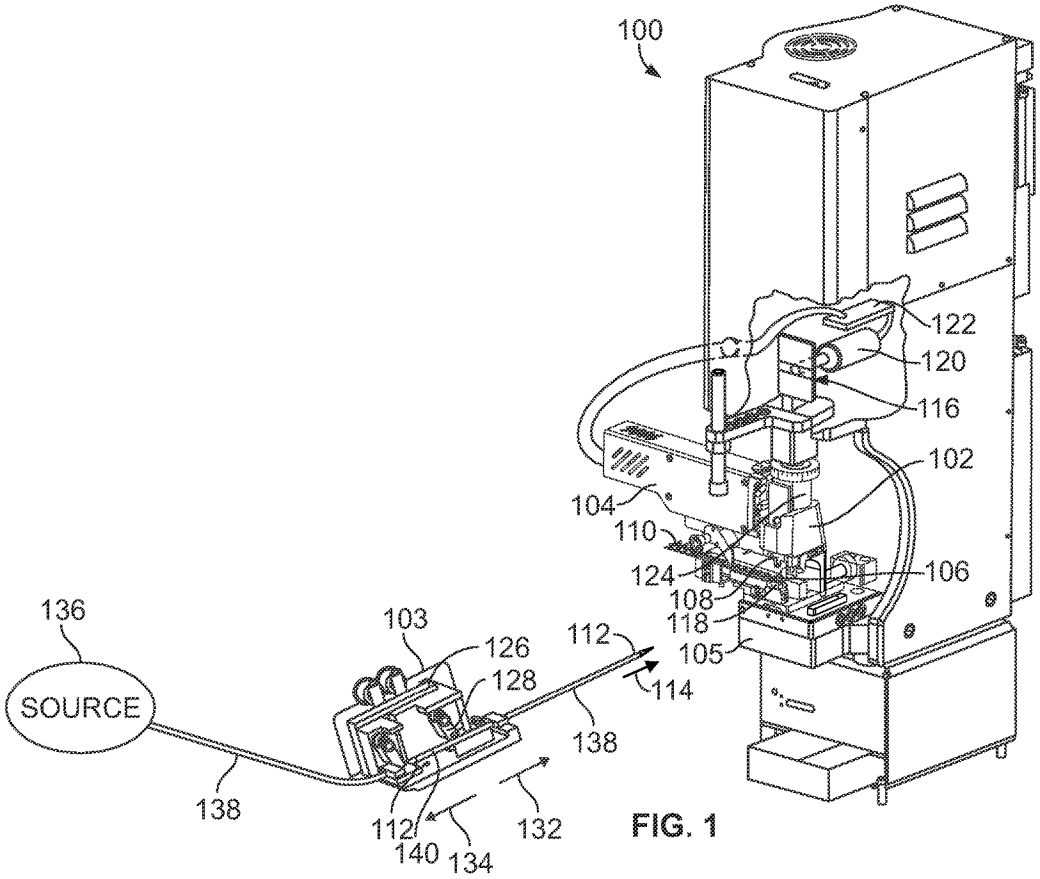
FIG. 1 is a perspective view of a terminal crimping system according to an exemplary embodiment.

FIG. 1 is a perspective view of a terminal crimping system 100 according to an exemplary embodiment. The terminal crimping system 100 includes at least an applicator 102 and a feeder device 103. The applicator 102 may be part of a bench machine or an automatic leadmaking machine, used for crimping connectors to wires. Alternatively, the applicator 102 may be part of another type of crimping machine such as a lead frame machine. However, other types of machines that attach connectors to wires using processes other than crimping may be used, such as an insulation displacement connector (IDC) machine, a welding machine, and the like.

The applicator 102 may be coupled to a base or support 105 of the terminal crimping system 100. The applicator 102 includes a movable ram 124 and a stationary anvil 118. The anvil 118 is located in a crimping or terminating zone 106 and receives a connector, such as a terminal 110, thereon. The movable ram 124 moves along a crimp stroke towards and away from the anvil 118 in the crimping zone 106. The movable ram 124 has crimp tooling 108 at a distal end thereof that is configured to crimp the terminal 110 on the anvil 118 to an end of a wire 112 that is disposed in the crimping zone 106 when the ram 124 moves toward the anvil 118. For example, the crimp tooling 108 may bend or pinch a barrel of the terminal 110 onto the end of the wire 112 within the barrel to electrically and mechanically connect the wire 112 and terminal 110, forming an electrical lead. During operation, the crimp tooling 108 may be driven through the crimp stroke by a driving mechanism 116 of the terminal crimping system 100. The driving mechanism 116 may be propelled by a terminator actuator 120. The terminator actuator 120 optionally may be a motor having a drive shaft that moves the driving mechanism 116. Alternatively, the terminator actuator 120 may be a linear actuator, a piezoelectric actuator, a pneumatic actuator, and the like. The operation of the terminator actuator 120 may be controlled by a control module 122.

The feeder device 103 is configured to deliver the wire 112 in a wire loading direction 114 to the crimping zone 106 of the applicator 102 for each crimp stroke of the ram 124. The feeder device 103 includes a frame 126 and a feed finger 128 mounted to the frame 126. The feed finger 128 is movable relative to the frame 126 along a feed stroke that includes movement of the feed finger 128 in a feed direction 132 and in an opposite return direction 134.

The feeder device 103 is configured to receive the wire 112 from a wire source 136, such as a coil of bulk wire. Optionally, the wire 112 may be directed to and/or from the feeder device 103 using one or more guide tubes 138. A portion of the wire 112 may be disposed across or within the feeder device 103. The feed finger 128 is configured to engage the wire 112 that is located across or within the feeder device 103 during at least part of the feed stroke of the feed finger 128. When the feed finger 128 engages the wire 112, movement of the feed finger 128 in the feed direction 132 moves the wire 112 that is engaged by the feed finger 128 in the feed direction 132. The wire 112 within the guide tube 138 between the feeder device 103 and the crimping zone 106 is moved in the wire loading direction 114. If the guide tube 138 is generally linear with the feed direction 132 of the feed finger 128, the wire loading direction 114 may be generally parallel with the feed direction 132, as shown in FIG. 1. During each feed stroke, the wire 112 may be advanced a distance that is generally equal to the distance that the feed finger 128 moves in the feed stroke while engaging the wire 112. In an embodiment, the feed finger 128 is pivotable towards and away from the wire 112, such that the feed finger 128 may engage the wire 112 when the feed finger 128 is pivoted towards the wire 112 and may disengage the wire 112 when the feed finger 128 is pivoted away from the wire 112.

Optionally, the terminal crimping system 100 may also include a terminal feeder 104 that is positioned to feed successive terminals 110 to the crimping zone 106 of the applicator 102 for crimping to the wire 112. The terminal feeder 104 may be positioned adjacent to, or even coupled to, the applicator 102. Alternatively, the terminal feeder 104 may be positioned remote with respect to the applicator 102, but still delivers the terminals 110 to the crimping zone 106. The terminal feeder 104 may be configured to deliver either side-feed terminals that are arranged side-by-side on a terminal carrier strip or end-feed terminals that are arranged end-to-end on the strip. The terminal feeder 104 illustrated in FIG. 1 is positioned to feed side-feed terminals 110.

Although the feeder device 103 shown and described in FIG. 1 is a wire feeder device, in other embodiments, the feeder device 103 may be a terminal feeder device used instead of the terminal feeder 104 to feed the terminals 110 to the crimping zone 106. Optionally, one feeder device 103 may be used to feed the wire 112 to the crimping zone 106, and a second feeder device 103 may be used to feed the terminals 110 to the crimping zone 106. As such, the feeder device 103 is configured to engage a feed object 140 that is not limited to the wire 112 shown in FIG. 1. For example, the feed object 140 may be a wire, a terminal strip, individual terminals, or the like.

Figure 2:
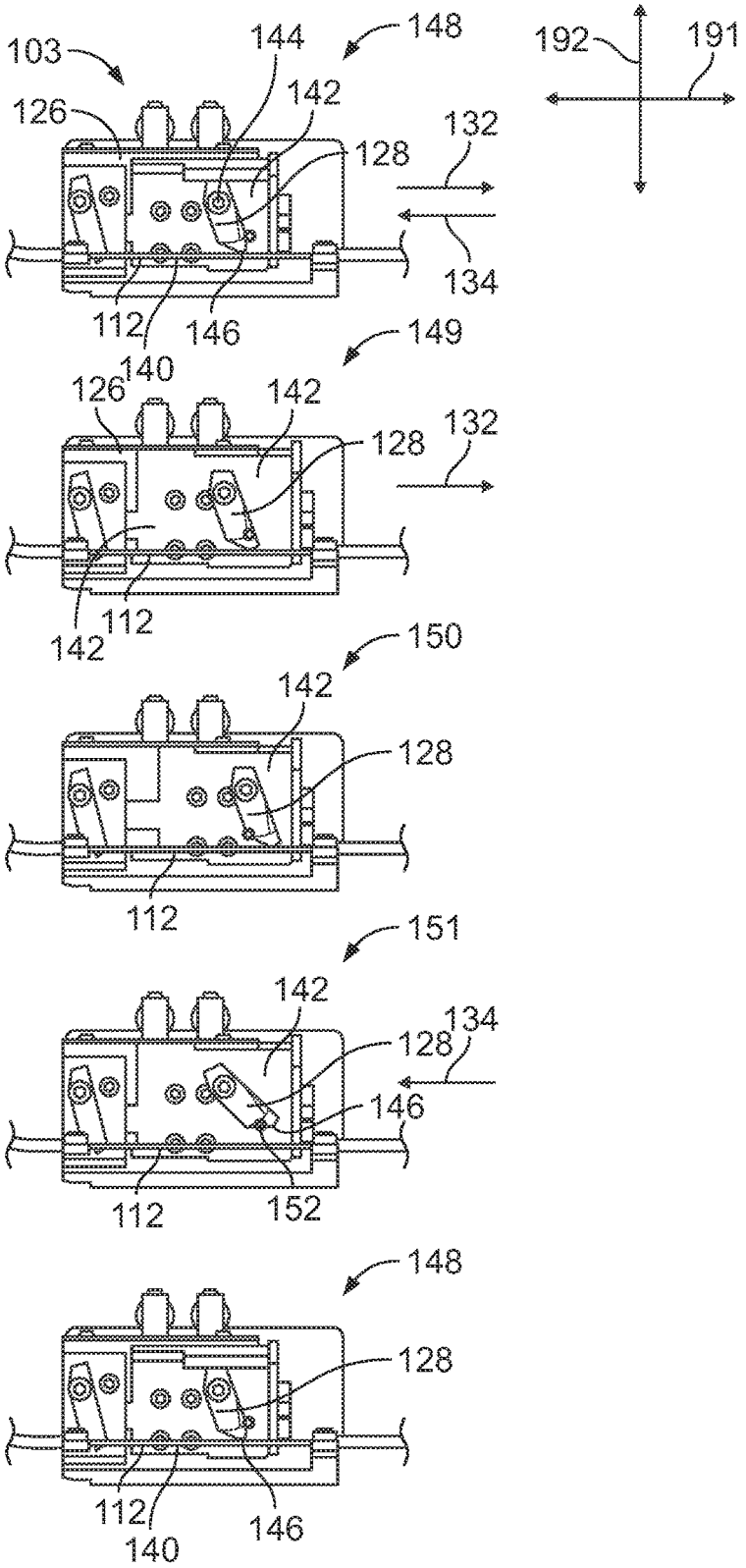
FIG. 2 is a side view of a feeder device at various positions during a feed stroke according to an embodiment.

FIG. 2 is a side view of the feeder device 103 at various positions along the feed stroke according to an embodiment. During a feed stroke, the feed finger 128 is moved from a retracted position in the feed direction 132 to an advanced position, and in the return direction 134 back to the retracted position. The feed finger 128 moves along a feed stroke axis 191. In an embodiment, the feed finger 128 is mounted to a movable carriage 142 via a fastener 144. The carriage 142 moves (for example, translates) relative to the frame 126. For example, the carriage 142 is configured to move the feed finger 128 in the feed and return directions 132, 134 along the feed stroke axis 191. The feed finger 128 may be pivotable on the fastener 144, which allows the feed finger 128 to pivot relative to the carriage 142. The feed finger 128 may have a distal edge 146 that is configured to engage the feed object 140 that is on or in the feeder device 103 during at least part of the feed stroke. The feed object 140 in the embodiment shown in FIG. 2 is the wire 112 (and is referred to as wire 112), although the feed object 140 may be other than a wire in other embodiments.

In position 148, the feed finger 128 of the feeder device 103 is in the retracted position 148 and is poised to begin a feed stroke. The retracted position 148 represents the furthest position of the feed finger 128 in the return direction 134 along the feed stroke axis 191. In the retracted position 148, the feed finger 128 may be pivoted towards the wire 112 such that the distal edge 146 engages the wire 112. As described further herein, the feed finger 128 may be biased towards the wire 112 such that the feed finger 128 engages the wire 112 unless the feed finger 128 is forced to pivot away from the wire 112 by a force greater than the biasing force. The feed finger 128 may be mounted to the carriage 142 above the wire 112 along an elevation axis 192 such that the feed finger 128 is pivoted downwards to engage the wire 112. Although the elevation axis 192 appears to extend in a vertical direction parallel to gravity in FIG. 2, it is understood that the axes 191, 192 are not required to have any particular orientation with respect to gravity. As used herein, relative or spatial terms such as "front," "back," "upwards," "downwards," and the like are only used to distinguish the referenced elements and do not necessarily require particular positions or orientations in the terminal crimping system 100 (shown in FIG. 1) or in the surrounding environment of the feeder device 103.

In position 149, the feed finger 128 is at a feed intermediate position 149. The carriage 142 and feed finger 128 are moving in the feed direction 132 relative to the frame 126. The feed finger 128 is engaged with the wire 112, and the wire 112 is propelled in the feed direction 132 by the movement of the feed finger 128. In position 150, the feed finger 128 is in the advanced position 150, which represents the further position of the feed finger 128 in the feed direction 132 along the feed stroke axis 191. As such, once the feed finger 128 reaches the advanced position 150, the carriage 142 no longer moves in the feed direction 132. In addition, the wire 112 is no longer propelled in the feed direction 132 once the feed finger 128 reaches the advanced position 150. The total distance that the wire 112 is advanced during one feed stroke may be the distance between the retracted position 148 of the feed finger 128 and the advanced position 150 of the feed finger 128. The carriage 142 begins to move in the return direction 134 after the feed finger 128 attains the advanced position 150.

In position 151, the feed finger 128 is at a return intermediate position 151. The carriage 142 and the mounted feed finger 128 are moving in the return direction 134 along the feed stroke axis 191 towards the retracted position 148. As shown in position 151, as the feed finger 128 is moved in the return direction 134, the feed finger 128 is pivoted away from the wire 112 and the distal edge 146 does not engage the wire 112. As described further herein, the feed finger 128 may be forced to pivot away from the wire 112 by a lifting arm 152. The feed finger 128 may pivot upwards along the elevation axis 192 to disengage the wire 112 that is disposed below the feed finger 128. As the carriage 142 continues to move in the return direction 134, eventually the feed finger 128 reaches the retracted position 148 again. In an embodiment, when the feed finger 128 reaches the retracted position 148, the feed finger 128 is pivoted toward the wire 112 such that the distal edge 146 of the feed finger 128 re-engages the wire 112 in preparation for upcoming movement in the feed direction 132.

Thus, the feeder device 103 is configured for the feed finger 128 to disengage the feed object 140 (for example, the wire 112) as the feed finger 128 moves in the return direction 134 towards the retracted position 148. By disengaging the feed object 140, the feed finger 128 avoids contacting the feed object 140 as the feed finger 128 moves in the return direction 134, which would potentially damage the feed object 140 (for example, by scraping the insulation off of the wire 112) and/or pull the feed object 140 backwards, misaligning the feed object 140 in the crimping zone 106 (shown in FIG. 1).

Figure 3:
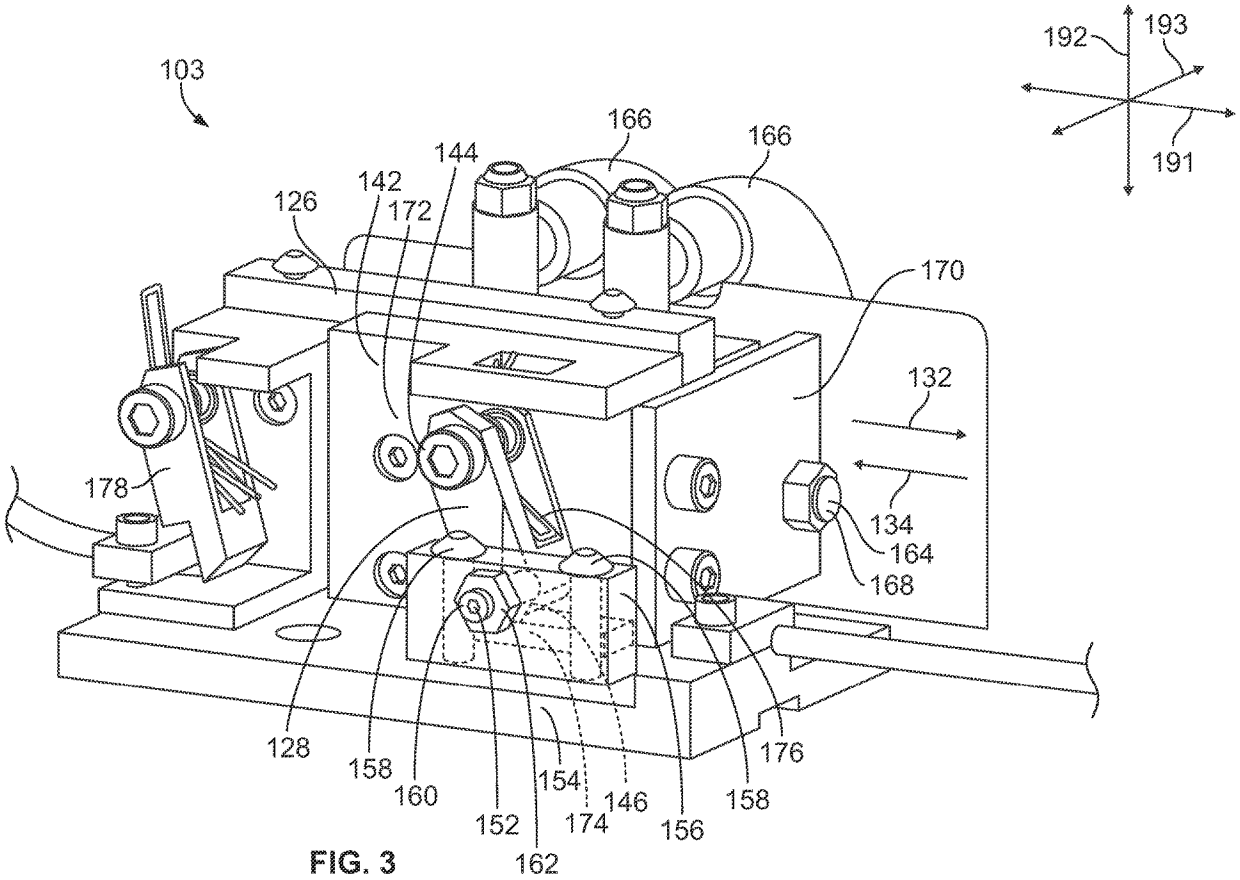
FIG. 3 is a perspective view of the feeder device shown in FIG. 2 according to an exemplary embodiment.

FIG. 3 is a perspective view of the feeder device 103 shown in FIG. 2 according to an exemplary embodiment. The frame 126 may include a base 154. In an embodiment, the lifting arm 152 may be indirectly mounted to the base 154 of the frame 126 via a block 156. The block 156 is shown in FIG. 3 as translucent or transparent for illustrative purposes. The block 156 may be mounted to the base 154 via an adhesive, a mechanical fastener, welding, soldering, or may be formed integral with the base 154. As shown in FIG. 3, the block 156 is mechanically fastened to the base 154 using two bolts 158. In other embodiments, other mechanical fasteners such as screws, nails, rivets, or the like, may be used to mount the block 156 to the base 154. The frame 126, the base 154, and/or the block 156 optionally may be formed of metal, plastic, or a combination thereof.

In an embodiment, the block 156 is disposed adjacent to the feed finger 128. The lifting arm 152 may extend from the block 156 towards the feed finger 128, or at least towards the path traversed by the feed finger 128 during the feed stroke. The lifting arm 152 may be oriented (for example, extend in a direction) transverse to the feed stroke axis 191. For example, the lifting arm 152 may extend along a lateral axis 193 that is perpendicular to the feed stroke axis 191. Optionally, the lateral axis 193 may also be perpendicular to the elevation axis 192 such that the axes 191-193 are mutually perpendicular. As shown in FIG. 3, the lifting arm 152 extends completely through the block 156 such that a distal end 204 (shown in FIG. 4) that includes a deflectable tip 202 (FIG. 4) protrudes towards the feed finger 128, and a proximal end 160 protrudes from an opposite side of the block 156 away from the feed finger 128. Optionally, the lifting arm 152 may include a lock nut 162 or another device that allows for adjustment and tuning of the length that the distal end of the lifting aim 152 extends from the block 156.

In an embodiment, the lifting arm 152 is fixedly mounted to the frame 126 via the block 156 and disposed adjacent to the feed finger 128, such that the feed finger 128 moves relative to the lifting arm 152 as the feed finger 128 is moved along the feed stroke axis 191 during the feed stroke. As described further herein, the deflectable tip 202 (shown in FIG. 4) of the lifting arm 152 engages the feed finger 128 as the feed finger 128 moves past the lifting arm 152. In an embodiment, the deflectable tip 202 is deflected as the feed finger 128 is moved in the feed direction 132, and the deflectable tip 202 is un-deflected as the feed finger 128 is moved in the return direction 134. The un-deflected tip 202 is configured to engage the feed finger 128 that is moving in the return direction 134 and pivot the feed finger 128 upwards, or away from the feed object 140 (shown in FIG. 1) to prohibit the feed finger 128 from engaging the feed object 140 while moving in the return direction 134.

The carriage 142 to which the feed finger 128 is mounted is propelled in the feed and return directions 132, 134 by a feeder actuator 164. The feeder actuator 164 is at least one of a linear actuator or a rotary actuator and is powered by electric, pneumatic, hydraulic, and/or mechanical power. In the illustrated embodiment, the feeder actuator 164 includes a linear air cylinder (not shown) that is coupled to hoses 166 that direct a gas therethrough to and from a cylinder. The gas optionally may be compressed air. A piston (not shown) inside the cylinder drives a rod 168 in the feed and return directions 132, 134. The rod 168 may be mechanically coupled to a front plate 170 of the carriage 142. Optionally the front plate 170 may be mechanically coupled to a body plate 172 of the carriage 142. The fastener 144 that mounts the feed finger 128 is coupled to the body plate 172. Therefore, movement of the rod 168 of the feeder actuator 164, via the front plate 170 and the body plate 172, causes the feed finger 128 to move similarly. For example, the feed finger 128 may move with the same or similar directions, speeds, and distances as the rod 168 of the feeder actuator 164. The feeder actuator 164 thus controls the speed of movement of the feed finger 128 and the locations of the advanced and retracted positions of the feed finger 128. In other embodiments, other types of feeder actuators may be used, such as electric motors, piezoelectric actuators, and the like.

In an embodiment, the feed object 140 (shown in FIG. 1), such as the wire 112 (FIG. 1) or the terminals 110 (FIG. 1), is received on a feed track 174 of the feeder device 103. In various embodiments, the feed track 174 may be part of the frame 126 or may be a part of the carriage 142. The feed track 174 is disposed at least under the distal edge 146 of the feed finger 128 to provide a support under the feed object 140. The feed finger 128 may be pivotably biased towards the feed object 140 and/or the feed track 174 by a biasing member 176. In the illustrated embodiment, the biasing member 176 is a torsion spring, but in other embodiments, the biasing member 176 may be a compression spring, a weight on or in the feed finger 128, or the like.

Optionally, the feeder device 103 may include a locking finger 178. The locking finger 178 may be pivotably attached to the frame 126 but does not translate relative to the frame 126. The locking finger 178 may provide a locking mechanism that allows the feed object 140 (shown in FIG. 1) to pivot the locking finger 178 and move past the locking finger 178 as the feed object 140 moves in the feed direction 132, while biting into the feed object 140 if the feed object 140 starts to move in the return direction 134. Thus, due to this ratcheting function, the locking finger 178 "locks" the feed object 140 in place once the feed finger 128 disengages the feed object 140, to prohibit the tension in the wire or terminal strip, for example, from pulling the feed object 140 in the return direction 134.

Figure 4:
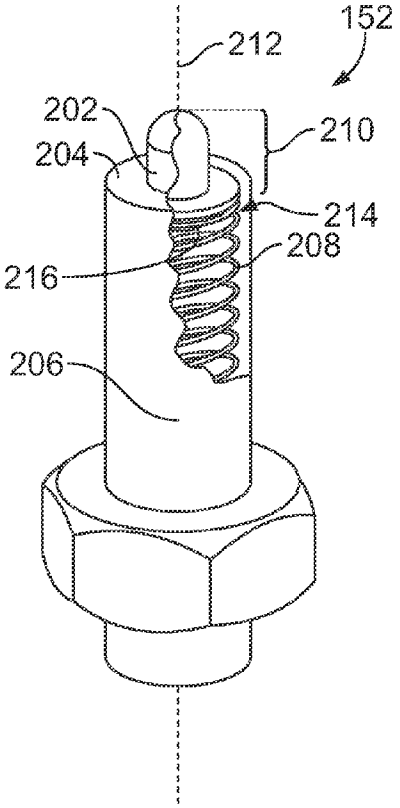
FIG. 4 is a partial cut-away view of a lifting arm according to an embodiment.

FIG. 4 is a partial cut-away view of the lifting arm 152 according to an embodiment. The lifting arm 152 is shown in a vertical orientation for illustrative purposes only. The lifting arm 152 includes a body 206. The deflectable tip 202 extends from a distal end 204 of the body 206. The body 206 may be a hollow rod or cylinder. A biasing member 208 may be within the body 206. The biasing member 208 may be a compression spring, as shown, or another compressive device, material, fluid, or the like. The biasing member 208 forces the tip 202 towards an un-deflected state. In the undeflected state, the deflectable tip 202 extends a length 210 from the distal end 204 of the body 206. The deflectable tip 202 may extend in an axial direction that is aligned with a longitudinal axis 212 of the body 206. The tip 202 may include a flange portion 216 at a proximal end that has a larger diameter than the rest of the tip 202 and prohibits the tip 202 from being discharged from the distal end 204 by the biasing member 208 (such that the tip 202 uncouples from the body 206). Optionally, the longitudinal axis 212 may be parallel to the lateral axis 193 (shown in FIG. 3).

In a deflected state, a force on the deflectable tip 202 shortens the length or distance that the tip 202 extends from the distal end 204. In the embodiment shown, the deflectable tip 202 is configured to deflect axially inwards, such that the tip 202 retracts into an interior cavity 214 within the body 206. In other embodiments, the deflectable tip 202 may be configured to deflect in other directions. For example, with reference to FIG. 3, the deflectable tip 202 may be configured to deflect upwards along the elevation axis 192 generally away from the feed track 174, outwards along the feed stroke axis 191 generally in the feed direction 132, or the like. Referring now back to FIG. 4, the lifting arm 152, including the body 206 and the deflectable tip 202, may be formed of metal and/or plastic. The lifting arm 152 may be a ball plunger or the like.

Figure 5:
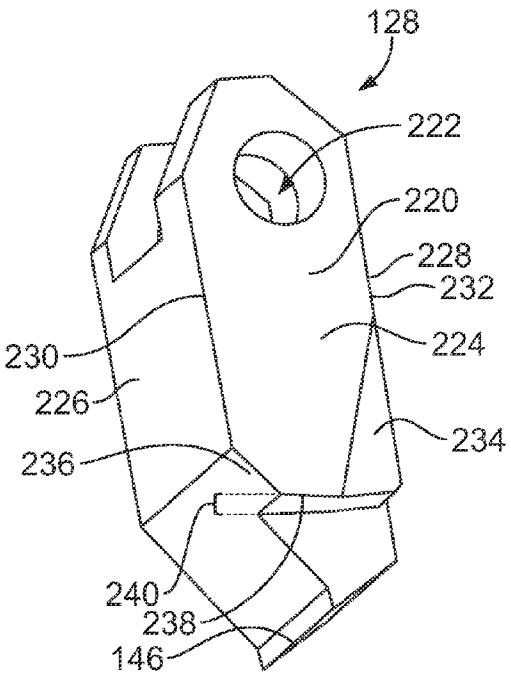
FIG. 5 is a perspective view of a feed finger according to an embodiment.

FIG. 5 is a perspective view of the feed finger 128 according to an embodiment. The feed finger 128 has a body 220 that is formed of plastic, metal, or the like. Optionally, the body 220 may be a one-piece body that is integrally formed by one or more common processes, such as by molding. The distal edge 146 may be tapered to a sharp edge or point to minimize the surface area that engages the feed object 140 (shown in FIG. 1) during the feed stroke. The feed finger 128 may also include at least one aperture 222 through which the fastener 144 (shown in FIG. 3) is received.

In an exemplary embodiment, the feed finger 128 includes multiple surfaces that are configured to engage the deflectable tip 202 (shown in FIG. 4) of the lifting arm 152 (FIG. 4) as the feed finger 128 is moved past the lifting arm 152 along the feed stroke. For example, the feed finger 128 includes a side 224, a rear 226, and a front 228 that is opposite the rear 226. A rear edge 230 is disposed at the interface between the rear 226 and the side 224. A front edge 232 is disposed at the interface between the front 228 and the side 224. In an embodiment, at least part of the front edge 232 is beveled to form a ramp surface 234, which is used to gradually deflect the deflectable tip 202 (shown in FIG. 4) of the lifting arm 152 (FIG. 4) as the feed finger 128 is moved in the feed direction 132 (shown in FIG. 3). In an embodiment, the rear edge 230 is not beveled, and at least part of the rear edge 230 and/or rear surface 226 defines a lifting ledge 236. The lifting ledge 236 engages the un-deflected tip 202 of the lifting arm 152 as the feed finger 128 is moved in the return direction 134 (shown in FIG. 3), which causes the feed finger 128 to pivot upwards away from the feed track 174 (shown in FIG. 3) and/or the feed object 140 (shown in FIG. 1). In addition, the side 224 of the feed finger 128 may define a release track 238 that extends between the lifting ledge 236 and the front edge 232. The release track 238 may be formed into the side 224 such that a width 240 of the track 238 extends along the lateral axis 193 (shown in FIG. 3). The width 240 need not be uniform along the length of the release track 238 between the lifting ledge 236 and the front edge 232. The release track 238 may be configured to receive the un-deflected tip 202 of the lifting arm 152 as the feed finger 128 is moved in the return direction 134 once the lifting ledge 236 is moved beyond the lifting arm 152 and the tip 202 disengages the lifting ledge 236. Since the feed finger 128 may be biased to pivot downwards, the release track 238 may rest on top of the un-deflected tip 202. In an embodiment, the release track 238 is at least one of curved or angled upwards away from the feed track 174 and/or the feed object 140 to allow the feed finger 128, which is biased to pivot downwards, to gradually lower towards the feed track 174 and/or feed object 140.

Figure 6:
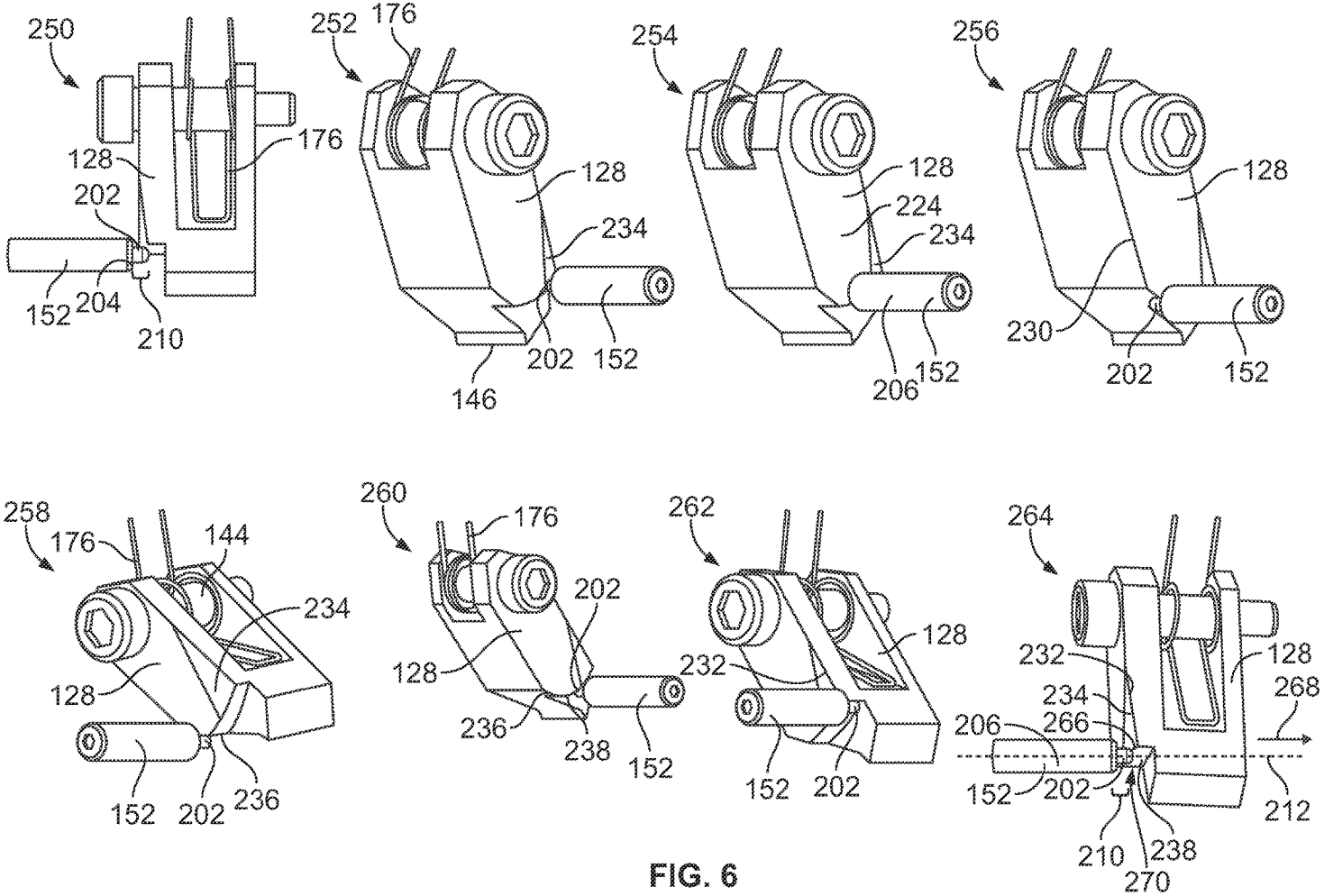
FIG. 6 illustrates a feed finger and a lifting arm of the feeder device at various positions during feed stroke according to an embodiment.

FIG. 6 illustrates the feed finger 128 and the lifting arm 152 of the feeder device 103 (shown in FIG. 3) at various positions and states during the feed stroke. At least some of the positions may correspond with positions of the feed finger 128 shown and described in FIG. 2. The positions shown in FIG. 6 may be in chronological order. At position 250, the feed finger 128 is in the retracted position 250. The feed finger 128 may be rearward of the lifting arm 152 in the retracted position 250, which may correspond with the retracted position 148 shown in FIG. 2. The feed finger 128 does not engage the lifting arm 152 in the retracted position 250, which allows the deflectable tip 202 to be in the un-deflected state, as represented by the tip 202 extending the length 210 from the distal end 204. As shown in the illustration of position 250, the tip 202 in the un-deflected state extends into the path of the feed finger 128. Due to the biasing member 176, the feed finger 128 is pivoted downwards towards the feed object 140 (shown in FIG. 1) and/or the feed track 174 (shown in FIG. 3).

Position 252 shows the feed finger 128 in a first feed intermediate position 252. As the feed finger 128 begins to move past the lifting arm 152 in the feed direction 132 (shown in FIG. 3), the ramp surface 234 is configured to engage the deflectable tip 202. For example, the ramp surface 234 may be the first surface of the feed finger 128 that engages the tip 202 of the lifting arm 152 as the feed finger 128 moves in the feed direction 132. Due to the slope of the ramp surface 234 and the movement of the feed finger 128, the ramp surface 234 gradually deflects the tip 202 from the un-deflected state to the deflected state, represented by the tip 202 extending from the distal end 204 a distance less than the max length 210. Thus, although the tip 202 in the un-deflected state may extend into the path of the feed finger 128, the ramp surface 234 deflects the tip 202 out of the path, allowing the feed finger 128 to move past the lifting arm 152. The deflection of the tip 202 allows the feed finger 128 to move past the lifting arm 152 while remaining pivoted downwards toward the feed object 140 (shown in FIG. 1) and/or the feed track 174 (shown in FIG. 3) so the movement of the feed object 140 along the feed track 174 is not interrupted by the interference with the lifting aim 152. In addition, the biasing member 208 (shown in FIG. 4) of the lifting arm 152 may exert a resistive force on the ramp surface 234 as the feed finger 128 moves past the lifting arm 152 in the feed direction 132. The resistive force may complement the biasing force exerted by the biasing member 176 in forcing the feed finger 128 downwards towards the feed object 140 on the feed track 174. The additional force supports the engagement of the distal edge 146 of the feed finger 128 to the feed object 140. For example, the resistive force exerted by the tip 202 of the lifting arm 152 on the ramp surface 234 may help to avoid slippage between the distal edge 146 of the feed finger 128 and the wire 112 (shown in FIG. 1)) that is being advanced towards the crimping zone 106 (shown in FIG. 1).

Position 254 represents a second feed intermediate position 254 of the feed finger 128. Once the ramp surface 234 of the feed finger 128 moves in the feed direction 132 (shown in FIG. 3) beyond the lifting arm 152, the deflectable tip 202 engages the side 224 of the feed finger 128. The deflectable tip 202 was gradually deflected by the ramp surface 234, and the tip 202 remains in the deflected state when engaged by the side 224. As shown in the illustration for position 254, the tip 202 is deflected into the body 206 of the lifting arm 152 and is not visible.

Position 256 represents the advanced position 256 of the feed finger 128. As the rear edge 230 of the feed finger 128 passes beyond the tip 202 of the lifting arm 152 while the feed finger 128 is moved in the feed direction 132 (shown in FIG. 3), the feed finger 128 disengages the tip 202, allowing the tip 202 to transition from the deflected state to the un-deflected state. Thus, as shown in the illustration representing the advanced position 256, the tip 202 is un-deflected, and extends into the rearward path of the feed finger 128.

Position 258 represents a first return intermediate position 258 of the feed finger 128. As the feed finger 128 begins to move in the return direction 134 (shown in FIG. 3) from the advanced position 256, the tip 202 of the lifting arm 152 engages the lifting ledge 236 of the feed finger 128. Since the tip 202 is in the un-deflected state and the lifting ledge 236 is not beveled, unlike the ramp surface 234, the lifting ledge 236 does not cause the tip 202 to deflect out of the path of the feed finger 128. Instead, the force of the un-deflected tip 202 on the lifting ledge 236 causes the feed finger 128 to pivot about the fastener 144 in the upward direction away from the feed object 140 (shown in FIG. 1) and/or the feed track 174 (shown in FIG. 3). The force exerted by the tip 202 of the lifting arm 152 on the feed finger 128 is greater than the biasing force by the biasing member 176 that forces the finger 128 downwards. As the lifting ledge 236 slides along the un-deflected tip 202, the feed finger 128 pivots upwards to a pivot apex position which represents the highest pivoted position of the feed finger 128 during the feed stroke. Optionally, the first return intermediate position 258 of the feed finger 128 may be the pivot apex position 258.

Position 260 represents a second return intermediate position 260 of the feed finger 128. Once the lifting ledge 236 of the feed finger 128 moves rearward of the lifting arm 152 as the feed finger 128 is moved in the return direction 134 (shown in FIG. 3), the un-deflected tip 202 may engage and slide along the release track 238. Since the un-deflected tip 202 is stationary relative to the feed finger 128 and the biasing member 176 applies a downward force on the feed finger 128, the release track 238 engages the un-deflected tip 202 from above. In an exemplary embodiment, the release track 238 is curved or angled in an upward direction away from the feed object 140 (shown in FIG. 1) and/or the feed track 174 (shown in FIG. 3). Thus, as the feed finger 128 is slides or drags over the un-deflected tip 202, the upward orientation of the release track 238 allows the feed finger 128 to gradually lower from the pivot apex position 258 towards the feed object 140 and/or the feed track 174. Due to the gradual lowering, once the tip 202 of the lifting arm 152 disengages the feed finger 128, the reduced distance to the feed object 140 and/or feed track 174 may prohibit damage and/or misalignment caused by the feed finger 128 pivoting downwards to re-engage the feed object 140. For example, the feed finger 128 may engage the feed object 140 on the feed track 174 at less force, velocity, and/or momentum by configuring the release track 238 to gradually lower the feed finger 128 rather than allow the feed finger 128 to pivot unrestricted from the pivot apex position 258 to the feed track 174.

Position 262 may represent a third return intermediate position 262 of the feed finger 128. Optionally, the feed finger 128 may disengage the un-deflected tip 202 of the lifting arm 152 once the front edge 232 of the feed finger 128 moves in the return direction 134 (shown in FIG. 3) beyond the deflectable tip 202. As such, the third return intermediate position 262 may represent the feed finger 128 just prior to disengaging the tip 202 and pivoting un-restricted downwards to re-engage the feed object 140 (shown in FIG. 1) on the feed track 174 (shown in FIG. 3).

Position 264 may represent the feed finger 128 in the retracted position 264 again after the feed finger 128 has disengaged the tip 202 of the lifting arm 152. Thus, position 264 may represent the same position as the position 250 and/or the retracted position 148 (shown in FIG. 2). As shown in the illustrated position 264, the release track 238 may intersect with the ramp surface 234 proximate to the front edge 232. Due to the beveled ramp surface 234, an outer edge 266 of the release track 238 may be angled to gradually extend away from the deflectable tip 202 of the lifting arm 152. For example, as the feed finger 128 is moved in the return direction 134 (shown in FIG. 3), the outer edge 266 of the release track 238 gradually moves away from the deflectable tip 202 in an axial direction 268 relative to the lifting arm 152. The axial direction 268 may be generally aligned with the longitudinal axis 212 of the body 206 of the lifting arm 152. Due to the angled outer edge 266 of the release track 238 proximate to the front edge 232 of the feed finger 128, the release track 238 may define a release portion 270. Optionally, the deflectable tip 202 of the lifting arm 152 may disengage the feed finger 128 along the release portion 270 prior to the front edge 232 of the feed finger 128 moving beyond the tip 202, as an alternative to the tip 202 disengaging the feed finger 128 at the front edge 232 as described in the description of position 262 above. For example, as the outer edge 266 of the release track 238 moves gradually away from the tip 202 in the axial direction 268, eventually the outer edge 266 may be located axially relative to the lifting arm 152 beyond the un-deflected length 210 of the tip 202, such that the un-deflected tip 202 no longer engages the release track 238. Thus, in one or more embodiments, the lifting arm 152 may disengage the feed finger 128 when the outer edge 266 of the release track 238 extends axially out of reach of the un-deflected tip 202 or when the front edge 232 of the feed finger 128 moves beyond the un-deflected tip 202 in the return direction 134.

Figure 7:
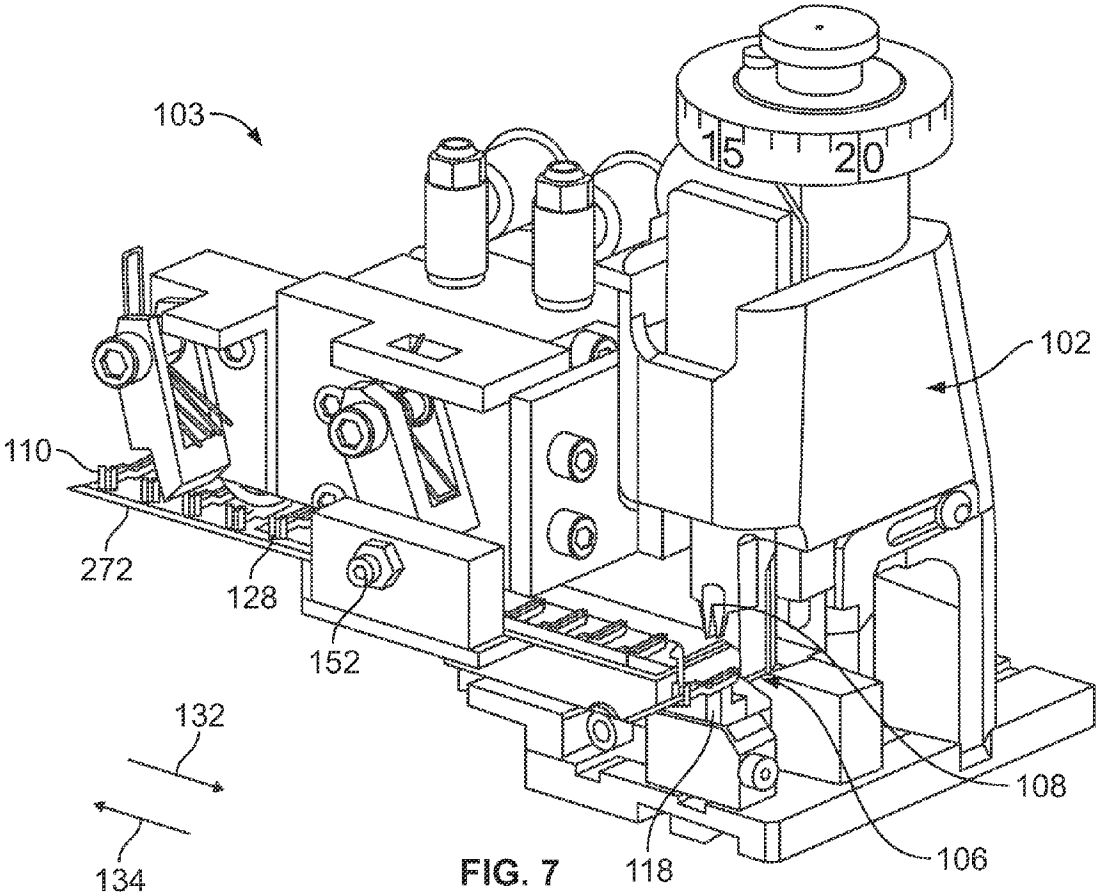
FIG. 7 is a perspective view of the feeder device used in an alternative application.

FIG. 7 is a perspective view of the feeder device 103 used in an alternative application as a terminal feeder device. For example, the feeder device 103 may be used to feed terminals 110 individually or on a terminal strip 272 towards the crimping zone 106 of the applicator 102. The feed finger 128 may engage a terminal 110 and/or the terminal carrier strip 272 during movement of the feed finger 128 in the feed direction 132 to advance a terminal 110 to the anvil 118 in the crimping zone 106. The terminal 110 on the anvil 118 may be crimped to a wire 112 (shown in FIG. 1) by the crimp tooling 108 of the applicator 102 to form an electrical lead. As the feed finger 128 moves in the return direction 134, the lifting arm 152 may pivot the feed finger 128 upwards to disengage the feed finger 128 from the terminals 110 and/or strip 272 to prohibit damaging the terminals 110 or moving the terminals 110 and/or strip 272 in the return direction 134, which would interfere with the positioning of the terminals 110. For example, rearward movement of the terminal strip 272 may pull the terminal 110 in the crimping zone 106 out of alignment with the anvil 118, requiring further adjustments to produce a quality lead. Optionally, one feeder device 103 may be used to advance the terminals 110 to the crimping zone 106, and another feeder device 103 may be used to advance the wire 112 to the crimping zone 106, as shown in FIG. 1.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A feeder device comprising:

a feed finger mounted to a frame and movable relative to the frame along a feed stroke that includes translational movement of the feed finger along a path in a feed direction and in an opposite return direction, the feed finger having a distal edge configured to engage a feed object during movement in the feed direction, the feed finger pivotable relative to the frame towards and away from the feed object, and a lifting arm fixedly mounted to the frame and disposed adjacent to the feed finger, the feed finger moving relative to the lifting arm as the feed finger is moved along the feed stroke, the lifting arm having a deflectable tip that extends into the path of the feed finger when in an un-deflected state of the deflectable tip, wherein the deflectable tip is deflected by the feed finger out of the path as the feed finger is moved in the feed direction and wherein, as the feed finger is moved in the return direction, the deflectable tip is in the un-deflected state and engages the feed finger, pivoting the feed finger relative to the frame away from the feed object.

2. The feeder device of claim 1, wherein the feed finger is pivotably biased towards the feed object by at least one of a torsion spring, a compression spring, or a weight.

3. The feeder device of claim 1, wherein as the feed finger is moved in the feed direction, the feed finger engages and advances the feed object in the feed direction, and as the feed finger is moved in the return direction, the feed finger does not engage the feed object.

4. The feeder device of claim 1, wherein the deflectable tip is deflected by a side of the feed finger as the feed finger is moved in the feed direction along the lifting arm.

5. The feeder device of claim 1, wherein a front edge of the feed finger between a side and a front of the feed finger is beveled to form a ramp surface, the ramp surface gradually deflecting the deflectable tip as the feed finger is moved in the feed direction.

6. The feeder device of claim 1, wherein a rear edge of the feed finger passes beyond the lifting arm during the feed stroke as the feed finger is moved in the feed direction such that the feed finger is spaced apart from the lifting arm and the deflectable tip, allowing the deflectable tip to transition towards the un-deflected state into the path of the feed finger.

7. The feeder device of claim 1, wherein a rear edge of the feed finger defines a lifting ledge, wherein the deflectable tip of the lifting arm in the un-deflected state engages the lifting ledge of the feed finger as the feed finger is moved in the return direction, causing the pivoting of the feed finger away from the feed object.

8. The feeder device of claim 7, wherein the feed finger defines a release track that extends between the lifting ledge and a front edge of the feed finger, the release track configured to receive the deflectable tip of the lifting arm that is un-deflected as the feed finger is moved in the return direction once the lifting ledge of the feed finger is moved beyond the lifting arm, wherein the release track is at least one of curved or angled away from the feed object to allow the feed finger to gradually lower towards the feed object.

9. The feeder device of claim 1, wherein the deflectable tip of the lifting arm disengages the feed finger as the feed finger is moved in the return direction once a front edge of the feed finger moves beyond the deflectable tip.

10. The feeder device of claim 8, wherein the release track includes a release portion proximate to the front edge of the feed finger, an outer edge of the release track along the release portion angled to gradually extend away from the deflectable tip of the lifting arm in an axial direction relative to the lifting arm, wherein the deflectable tip of the lifting arm disengages the feed finger as the feed finger is moved in the return direction once the outer edge of the release track is axially located relative to the lifting arm beyond the length of the un-deflected tip.

11. The feeder device of claim 1, wherein the frame includes a base and the lifting arm is indirectly mounted to the base of the frame via a block, the lifting arm extending from the block and oriented transverse to a feed stroke axis defined by the movement of the feed finger along the feed stroke.

12. The feeder device of claim 1, wherein the feed finger is mounted to a movable carriage via a fastener, the carriage configured to move the feed finger in the feed and return directions, the feed finger pivotable on the fastener relative to the carriage.

13. The feeder device of claim 1, wherein the feed finger is moved in the feed and return directions by a feeder actuator, the feeder actuator controlling a speed of movement of the feed finger and locations of advanced and retracted positions of the feed finger.

14. The feeder device of claim 1, wherein the lifting arm includes a cylindrical body that defines an interior cavity, the deflectable tip protruding from a distal end of the body when in the un-deflected state and configured to retract axially into the interior cavity of the body when deflected by the feed finger.

* * * * *